United States Patent [19]

Baudoin

[11] 4,452,182

[45] Jun. 5, 1984

[54] SODIUM-WATER TYPE STEAM GENERATORS

[75] Inventor: André Baudoin, Marly le Roi, France

[73] Assignees: Creusot-Loire; Commissariat a l'Energie Atomique, both of Paris, France

[21] Appl. No.: 391,742

[22] Filed: Jun. 24, 1982

[30] Foreign Application Priority Data

Jul. 17, 1981 [FR] France ..... 81 13941

[51] Int. Cl.[3] ..... F22B 1/02

[52] U.S. Cl. ..... 122/32; 165/134 R; 165/40; 165/70

[58] Field of Search ..... 122/32, 34, 504; 165/134 R, 70, 40

[56] References Cited

U.S. PATENT DOCUMENTS 3,924,675 12/1975 Essbaggers ..... 122/32 X 4,284,134 8/1981 Harris ..... 122/32 X 4,307,685 12/1981 Robin et al. ..... 122/32

*Primary Examiner*—Edward G. Favors

*Attorney, Agent, or Firm*—Pollock, Vande Sande & Priddy

[57] ABSTRACT

Steam generator of the sodium-water type comprising a primary circuit constituted by an elongated vessel filled with liquid sodium, an inlet zone of the elongated vessel into which the liquid sodium is introduced, an outlet zone of the elongated vessel from which the liquid sodium is removed, and a secondary circuit constituted by a plurality of water circulation tubes extending to the inside of the elongated vessel. Inside the elongated vessel is arranged a tank open only downwards, immersed in the sodium contained in the vessel, and at least partly filled with an inert gas, so as to constitute in the vessel, at the level of the outlet zone of the sodium, an expansion tank for limiting the propagation of a pressure wave resulting from chemical reaction between the sodium and the water. The generator is particularly useful in nuclear power stations.

2 Claims, 2 Drawing Figures

SODIUM-WATER TYPE STEAM GENERATORS

FIELD OF THE INVENTION

The present invention relates to an improvement in or to steam generators of the sodium-water type used particularly in nuclear power stations.

BACKGROUND OF THE INVENTION

In electric power stations, a boiler brings heat to the fluid of a closed loop circuit, this heated fluid then flowing into a steam generator in order to yield its heat to the water which is converted into steam, this steam then being sent to the turbines of the power plant.

In certain nuclear power stations, particularly of the fast breeder type, it is known to use liquid sodium as a fluid serving for the transport of heat from the boiler to the generator. In this case, the steam generator is constituted by a heat exchanger the primary circuit of which contains liquid sodium and the secondary circuit of which contains water converted to steam.

In such steam generators, very special precautions are taken to avoid any contact between the liquid sodium of the primary circuit and the water of the secondary circuit. In fact, it is known that the mixing of sodium and water at high temperature causes very violent chemical reactions, with a release of gas and sudden increase in the pressure existing in the liquid sodium. These accidental sudden chemical reactions, which can result in an explosion inside the steam generator, can cause partial deterioration of certain parts of the steam generator, but also, due to the fact of the propagation of the pressure wave in the pipes of the primary circuit caused by the accidental explosion in the steam generator, can cause damage to the core of the reactor or of the intermediate exchangers, or damage to the circulating pumps or any other installation situated in this primary circuit.

It is known to arrange in different parts of the sodium circuit various apparatuses enabling the effects of the sodium water reaction to be limited. It is known, for example, to shunt at the outlet of the sodium of the steam generator a connection to a storage tank closed by a rupture diaphragm, this diaphragm being provided so as to burst rapidly as soon as the pressure of the sodium exceeds a certain value, in order to establish a by-pass for the sodium at excess pressure to a storage tank. It is also known to shunt, on the piping of the primary circuit arriving at the circulation pumps and at the intermediate heat exchangers, an expansion tank enabling the intensity of the pressure wave to be considerably attenuated, before it is propagated into these pumps and these intermediate exchangers.

On the other hand, it is known to arrange the steam generator so that in its upper zone a pocket of inert gas is enclosed, which permits the creation of a free level which very considerably attenuates the pressure waves transmitted in the sodium inlet pipes.

When a primary circuit containing liquid sodium comprises a steam generator the upper part of which contains a gas pocket and comprises on the other hand an expansion tank connected to the circuit through a pipe of large diameter, situated at a certain distance from the steam generator, there has been observed a mass oscillation phenomenon between the two pockets of gas on accidental sodium-water reactions or on simulations of these reactions which are done to test the installation. This swinging phenomenon is similar to that which would exist in a system of communicating tanks closed at their upper part and having a very high gas flow suddenly injected into one of the two tanks. In the same way, in a conventional installation comprising a steam generator provided with a free level and an expansion tank connected in the circuit, the more the inertia of the liquid sodium mass which is situated between the two free levels, the greater the amplitudes of the oscillations. Although the expansion tank is intended to limit the effects of the pressure waves, it is seen that it cannot eliminate considerable excess pressure in the circuits, troublesome for the whole of the installation and particularly for intermediate exchangers which are frequently installed to isolate a first liquid sodium circuit passing into the core of the reactor from the liquid sodium circuit passing into the steam generators.

SUMMARY OF THE INVENTION

It is an object of the present invention to overcome these various drawbacks.

According to the present invention there is therefore provided a steam generator of the sodium-water type, particularly for nuclear power stations, comprising a primary circuit constituted by an elongated vessel in which liquid sodium flows are introduced into the vessel at the level of an inlet zone and removed from the vessel at the level of an outlet zone, and a secondary circuit constituted by a plurality of water-circulating tubes extending into the interior of the vessel.

According to the invention, in the inside of the elongated vessel is arranged a tank open only downwards, immersed in the sodium contained in the vessel, and filled at least partly with an inert gas, so as to constitute in the vessel, at the level of the outlet zone of the sodium, an expansion tank limiting the propagation of a pressure wave resulting from an accidental chemical reaction between the sodium and the water.

The invention relates also to the whole of the heat-carrying circuit particularly for nuclear power stations, comprising liquid sodium circulating in closed loops.

According to the invention, such a heat carrying circuit comprises as a by-pass an expansion tank connected to the circuit by piping of small diameter enabling, in a conventional manner, the sodium transfer from the tank to the circuit or vice-versa, on thermal variations, and on the other hand traverses the primary circuit of a steam generator as previously described, i.e., a steam generator comprising, inside its vessel of the primary circuit, at the level of the outlet zone of the sodium, a tank open only downwards, immersed in the sodium contained in the vessel, and filled at least partly with inert gas so as to constitute a free level limiting the propagation of a pressure wave resulting from accidental chemical reaction between the sodium and the water.

BRIEF DESCRIPTION OF THE DRAWINGS

In order that the invention may be clearly understood, a preferred embodiment of the invention will now be described with reference to the accompanying drawings, in which.

DETAILED DESCRIPTION

Figure 1:
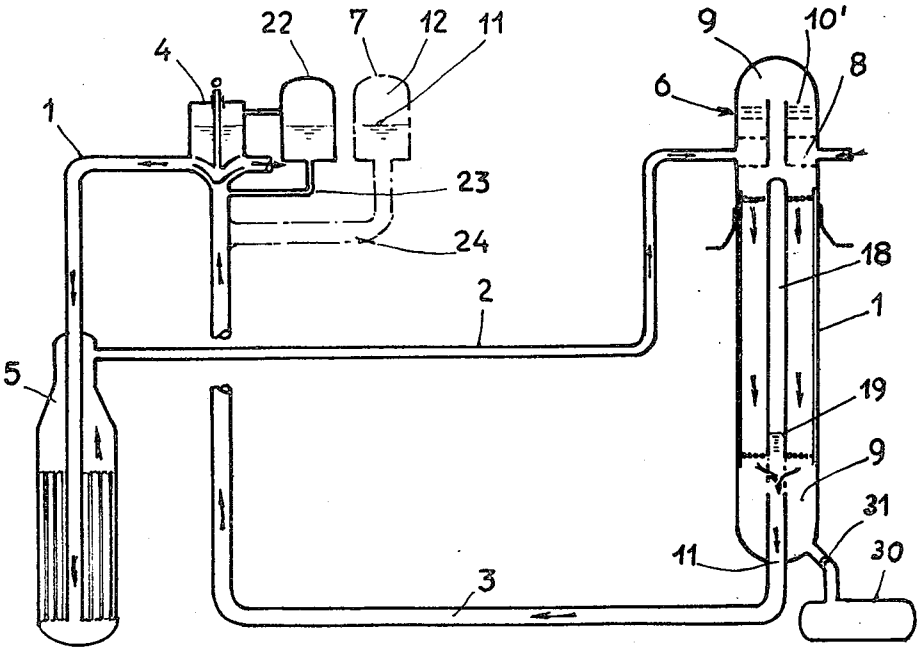
FIG. 1 shows diagrammatically an elevation of a cooling circuit for nuclear power stations according to the invention.

FIG. 1 shows a secondary cooling circuit for nuclear power stations the general layout of which is quite conventional. This circuit includes a set of pipes 1, 2, 3 which transport liquid sodium in a closed circuit. The liquid sodium circulates so as to take the heat in the intermediate exchanger 5 to yield it up to the steam generator 6 by causing, in this steam generator, the conversion of water into steam in the secondary circuit, this steam being used conventionally to rotate the turbines of the power plant. After having passed into the steam generator, the liquid sodium returns through the pipe 3 to the circulating pump 4, before recommencing its cycle.

The steam generator 6 is hence a heat exchanger the primary circuit of which contains liquid sodium and the secondary circuit of which contains water. If a rupture occurs in this steam generator, resulting in mixing of a certain amount of sodium with water, a sudden chemical reaction follows which has the effect of an explosion inside the steam generator and which results in a sudden rise in pressure in the sodium circuit. In a conventional installation, the pressure wave which results from this explosion can be propagated through the pipe 3, then through the pipe 1, arrive in the intermediate exchanger 5 and cause its breakage. To protect this intermediate exchanger 5 which constitutes a barrier between the radioactive liquid sodium passing through the core of the reactor and the uncontaminated liquid sodium passing through the steam generator, it has already been proposed to arrange, as a branch to the pipe bringing the sodium to the intermediate exchanger 5, a large capacity expansion tank, connected to the pipe through a large diameter tube. To illustrate this known solution, such a branch connection of an expansion tank 7 has been shown in dotted lines in FIG. 1. Also shown is a steam generator 6 the introduction chamber 8 of which for the sodium is arranged conventionally at the top part of the steam generator and encloses an inert gas pocket 9 which determines a free level of the sodium. It has been noted that, when there was provided thus in known manner for the whole of this steam generator 6 to be connected through the pipes 1, 2 and 3 to this expansion tank 7, on simulation of the sodium-water reactions which were done to test the installation, the masses of sodium contained in the pipes were drawn into large amplitude oscillations associated with considerable pressure variations in the circuit which can be of the same order of magnitude as the pressure waves which would exist if there were no expansion tank. It is therefore seen that this expansion tank 7 is not very effective.

The present invention is intended to overcome these drawbacks by means of a steam generator 6 including certain novel features which enable the branching of the expansion tank 7 to the circuit by means of a large diameter tube 24 designed to limit the propagation of a pressure wave, to be avoided.

Figure 2:
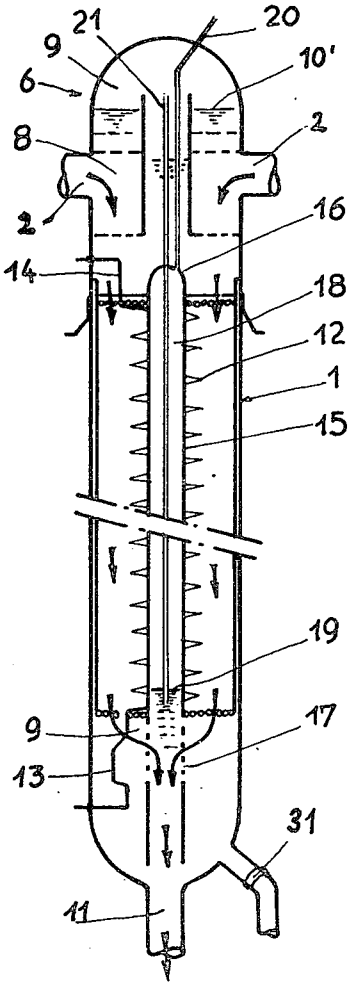
FIG. 2 shows diagrammatically in longitudinal section a steam generator according to the invention.

The steam generator according to the present invention, enabling such a branching to be avoided, is shown in FIG. 2 in more detail. This steam generator comprises a cylindrical vessel 1 of elongated shape and arranged vertically, filled with liquid sodium in circulation constituting the primary circuit. The liquid sodium arrives at the steam generator 6 through the pipes 2, is introduced into the inlet chamber 8 situated at the upper part of the steam generator, flows from above downwards inside the cylindrical vessel 1, and arrives at the outlet zone 9 situated at the lower part of the steam generator whence it is removed through the pipe 11. The steam generator shown in this embodiment includes a secondary circuit constituted by a multitude of tubes 12 arranged helicoidally and in which water flows introduced through the lower part 13 of the tubes and re-emerging through the upper part 14 of the tubes in the form of steam. As the tubes 12 cannot be wound helicoidally with too small a radius, the central portion of the steam generator is not occupied by the tubes 12 and provision is therefore made to install therein a cylinder 15 of elongated shape. This cylindrical jacket 15 extending longitudinally to the center of the steam generator is not completely superfluous, since it contributes to the rigidity of the whole and/or to the maintenance in position of the tubes 12. However, in the steam generator 6 according to the present invention this cylindrical jacket 15 also includes various arrangements which enable it to fulfil other functions to be described hereinbelow.

The jacket 15 is arranged longitudinally at the center of the steam generator, vertically, is closed at its upper part 16 and comprises openings 17 at its lower part. The inside of this jacket 15 is filled with a certain amount of an inert gas 18 which forms at the upper part of the jacket 15 a pocket and which defines a free surface 19 of the liquid sodium. A tube 20 leads the necessary inert gas into the upper part of the jacket 15, and a tube 21 extends vertically inside the vessel 15, its bottom end being situated relatively low in the jacket 15, so that, when the inert gas is introduced into the chamber 18 through the tube 20, the level of the free surface 19 of the liquid sodium does not drop below the lowest point of the tube 21. If, in the steam generator 6 described previously an explosion occurs due to a violent sodium-water reaction, the pressure wave resulting therefrom is considerably damped, in the interior itself of the steam generator, due to the elasticity of the gas pocket 18, thus avoiding this pressure wave from being propagated in considerable proportions through the sodium outlet pipe 11, in the direction of the other equipment situated in this circuit, i.e., the circulating pumps and especially the intermediate exchangers. In other words, the space occupied by the cylindrical jacekt 15 which is to be found in certain known steam generators is arranged, according to the present invention, so as to constitute an inner expansion tank to the steam generator, formed economically since it is constituted to a large extent by elements which exist in any case, not occupying any additional space, and confining strictly to the steam generator the mechanical stresses occasioned by an accidental sodium-water reaction in the latter.

The heat transfer circuit comprising a steam generator according to the present invention, as shown in FIG. 1, may be supplemented by a deviation, close to the steam generator liquid sodium outlet, this deviation being obturated in normal operation by a rupture diaphragm 31 designed to break when the pressure of liquid sodium at the outlet of the steam generator exceeds a certain value, in order to place this outlet of the steam generator in communication with the storage tank 30. This arrangement of the rupture diaphragm and of the storage tank is known per se and here plays a role quite identical with that which it plays in installations including a conventional steam generator. It is known that such a rupture diaphragm 31 only permits the amplitude of the pressure wave to be partly arttenuated upon possible sodium-water reaction in the steam generator.

In addition, it is advantageous to arrange in the installation according to the invention (FIG. 1), at the level of the circulating pump 4, a surge tank 22 connected to the pipe 3 through a tube of small diameter 23, this surge tank 22 only enabling compensation of the expansion variations of the sodium. Of course, its coupling through a small diameter tube to the pipe 3 is not at all adapted to the function of limitation of propagation of the pressure wave.

At first glance, it might appear that, in the steam generator 6 according to the present invention, the simultaneous existence of two free surfaces 10 and 19 respectively surmounted by an inert gas pocket 9 and 18 could also cause a system of oscillations at the level of the two free surfaces. In fact, the oscillation phenomenon only becomes significant when the distances which separate two free surfaces are sufficiently great, involving a sufficiently large mass of liquid sodium in movement. In the steam generator 6, the distance separating the two free surfaces 10 and 19 is very small since these two surfaces are situated in the same apparatus, and consequently the mass of liquid sodium existing between its two free surfaces is substantially the mass of liquid sodium contained in the cylindrical vessel 1 of the steam generator, which is too small to produce oscillations of any magnitude.

The invention is not limited to the described embodiments. It is possible, for example, to apply the features according to the present invention to a steam generator the secondary circuit tubes of which are arranged other than helicoidally, or of which the inputs and outputs of liquid sodium are differently located.

I claim:

1. Steam generator of the sodium-water type, particularly for nuclear power stations, comprising (a) a primary circuit constituted by an elongated vessel (1) filled with liquid sodium;

(b) an input zone (8) of said elongated vessel into which said liquid sodium is introduced;

(c) an outlet zone (9) of said elongated vessel (1) in which said liquid sodium is removed;

(d) a reservoir (15) immersed in the liquid sodium contained in said elongated vessel, partly filled with an inert gas (18) defining a free level of said liquid sodium; and (e) a secondary circuit constituted by a plurality of water circulating tubes extending at the interior of said elongated vessel, (f) a lower portion of said reservoir (15) communicating directly with said elongated vessel (1) in order to form a free passage in both directions of said liquid sodium, limiting in the entire steam generator the propagation of a pressure wave resulting from a sudden accidental chemical reaction between said sodium and water.

2. Steam generator of the sodium-water type according to claim 1, comprising a first tube (20) for providing said inert gas (18) to an upper portion of said reservoir (15), and a second tube (21) extending vertically within said reservoir (15) and having its lower end located relatively low in said reservoir, whereby the level of the free surface (19) of said liquid sodium does not drop below the lowest point of said second tube (21) at the moment of introduction of said inert gas (18) into said reservoir (15) via said first tube (20).

* * * * *